United States Patent [19]

Kurata

[11] Patent Number: 4,462,350

[45] Date of Patent: Jul. 31, 1984

[54] LUBRICATION APPARATUS IN INTERNAL COMBUSTION ENGINE

[75] Inventor: Noboru Kurata, Kamifukuoka, Japan

[73] Assignee: Honda Giken Kogyo Kabushiki Kaisha, Tokyo, Japan

[21] Appl. No.: 424,185

[22] Filed: Sep. 27, 1982

[30] Foreign Application Priority Data

Sep. 28, 1981 [JP] Japan ..... 56-142621[U]

[51] Int. Cl.[3] ..... F01M 1/00

[52] U.S. Cl. ..... 123/196 CP; 123/196 S; 184/6.28

[58] Field of Search ..... 123/195 R, 196 S, 196 CP; 184/6.28, 6

[56] References Cited

U.S. PATENT DOCUMENTS

| | | | |
|---|---|---|---|
| 1,203,290 | 10/1916 | Weiland | 123/196 R |
| 2,550,967 | 5/1951 | Burks et al. | 184/6.28 |
| 3,143,187 | 8/1964 | Stefan | 123/196 R |
| 3,425,511 | 2/1969 | Severin | 184/6 |
| 3,465,847 | 9/1969 | Donath et al. | 123/196 AB |
| 3,485,324 | 12/1969 | Novak | 123/196 R |
| 3,590,953 | 7/1971 | Wellauer | 184/6 |

FOREIGN PATENT DOCUMENTS

| | | | |
|---|---|---|---|
| 1241420 | 11/1959 | France | 123/196 R |

*Primary Examiner*—Ethel R. Cross

*Attorney, Agent, or Firm*—Armstrong, Nikaido, Marmelstein & Kubovcik

[57] ABSTRACT

A lubrication apparatus for an internal combustion engine is provided which has a crank chamber with an oil pan detachably mounted on the lower surface of the crank chamber. An oil pump and an oil filter are coupled together by an oil passage in the crank chamber. A relief valve is provided in the oil passage, the relief valve being opened by an oil pressure above a predetermined value. The oil passage includes an opening directed towards the oil pan and the oil pan includes a rib formed on the upper surface thereof, wherein the relief valve is inserted in the opening and is supported therein by the rib.

5 Claims, 2 Drawing Figures

LUBRICATION APPARATUS IN INTERNAL COMBUSTION ENGINE

BACKGROUND OF THE INVENTION

1. Field of the Invention

This invention relates to a lubrication apparatus in an internal combustion engine chiefly used for a vehicle.

2. Description of the Prior Art

Prior art lubrication systems are used in which an oil pan is detachably provided on the lower surface of a crank chamber of an internal combustion engine in order to close the crank chamber. An oil pump having an oil intake opening and an oil filter which is in communication with the oil pump through a communication passage are provided in the crank chamber, and the communication passage has a relief valve arranged to be opened by an oil pressure above a predetermined value. Normally, in this type of apparatus, the relief valve is fixed to the pump or the crank chamber by being fastened thereto by means of a screw or the like, and accordingly, this arrangement results in difficulty in attaching and detaching of the relief valve and requires much trouble and nuisance.

SUMMARY OF THE INVENTION

It is an object of the present invention to provide a lubrication apparatus in which a relief valve in the oil passage between the oil pump and oil filter, is supported by the oil pan without the need for a screw, thereby facilitating the insertion and removal of the valve and making the mounting more stable.

The present invention is directed to a lubrication apparatus for an internal combustion engine having a crank chamber with an oil pan detachably mounted on the lower surface of the crank chamber. An oil pump and an oil filter are coupled together by an oil passage in the crank chamber. A relief valve is provided in the oil passage, the relief valve being opened by an oil pressure above a predetermined value. The oil passage includes an opening directed towards the oil pan and the oil pan includes a rib formed on the upper surface thereof, wherein the relief valve is inserted in the opening and is supported therein by the rib.

DETAILED DESCRIPTION OF THE PREFERRED EMBODIMENT

Figure 1:
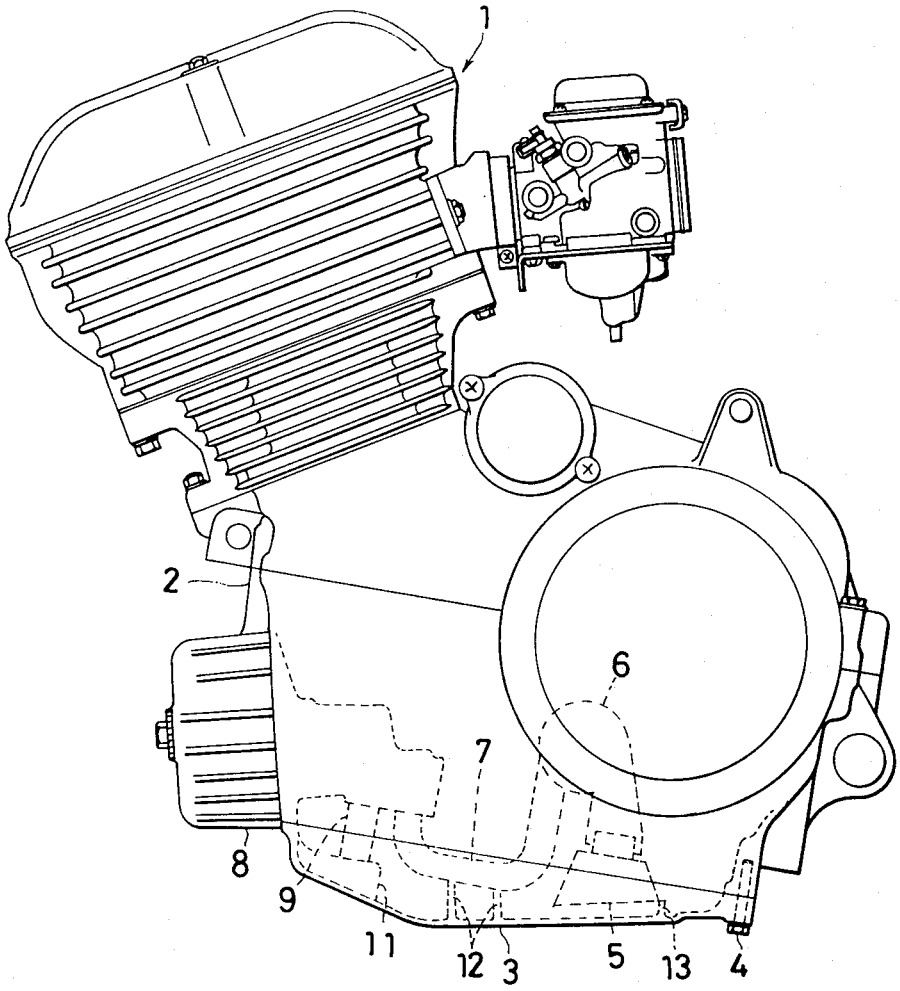
FIG. 1 is a side view, partly omitted, of the preferred embodiment of the present invention.
Figure 2:
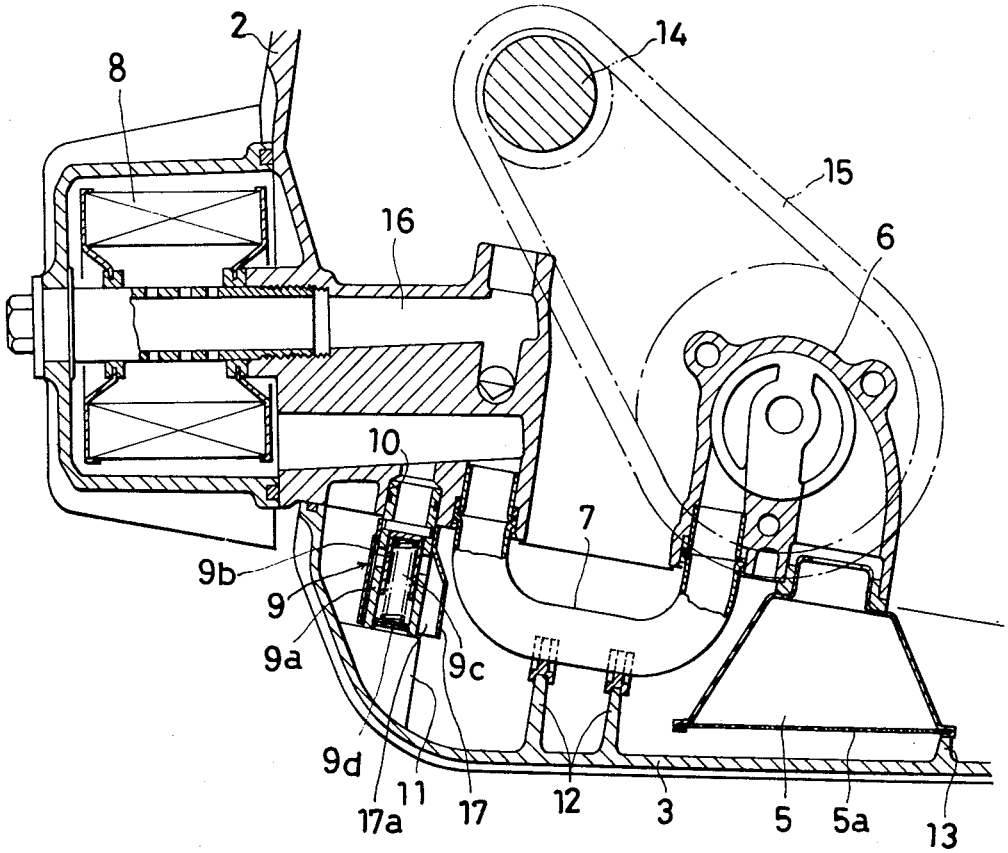
FIG. 2 is an enlarged partial sectional side view thereof.

Referring to the drawings, an internal combustion engine 1 has a crank chamber 2. An oil pan 3 is detachably mounted on the lower surface of the crank chamber 2 by being fastened thereto by means of a screw 4 or the like. An oil pump 6 having an oil intake opening 5, and an oil filter 8 communicates with the oil pump 6 through a communication passage 7 located in the crank chamber 2. The communication passage 7 is provided with a relief valve 9 which is opened by an oil pressure above a predetermined value.

According to this invention, the communication passage 7 has an opening 10 therein which is directed towards the oil pan 3 and the relief valve 9 is inserted in the opening 10 and is supported from behind by the oil pan 3.

In the above embodiment, the oil pan 3 has a rib 11 on its upper surface which supports the valve 9, and in this case, the rib 11 is made so that its thickness is comparatively small. The relief valve 9 comprises a surrounding tubular casing **9*a* and a valve body 9*b* slidably mounted therein. A chamber 9*c* defined in the valve body 9*b* communicates with the exterior through an opening 9*d* made in the lower surface thereof, and in this case, the rib 11 has a thickness smaller than the opening 9*d***.

A plurality of screws 4 are disposed at spaced intervals on the peripheral portion of the oil pan 3, and each screw 4 lies on an axial line which is in parallel with the axial line of the tubular opening 10.

A tube which forms the communication passage 7 and an oil filter screen **5*a* which covers an open end portion of the intake opening 5 are also supported from below by the oil pan 3. In particular, the tube 7 is supported from below by a rib 12 formed on the upper surface of the oil pan 3, and the screen 5*a* is supported from below by a rib 13 formed on the upper surface of the oil pan 3**.

The pump 6 is driven by an output shaft 14 of the engine 1 through a chain 15 or the like, and the oil filter 8 is in communication on its outlet side with an oil supply passage 16.

Referring to the drawings, numeral 17 denotes a tubular guide member surrounding the tubular casing **9*a* of the relief valve 9, and the same serves to form therein an oil guide passage 17*a*** extending downwards.

Thus, according to this invention, the relief valve is inserted in the opening in the communication passage and is supported from below by the oil pan, so that attaching and detaching of the valve is simpler and easier than in a conventional apparatus in which the valve is fastened by means of a screw. Furthermore, the attached condition thereof becomes more stable.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A lubrication apparatus in an internal combustion engine having a crank chamber comprising:

(a) an oil pan detachably mounted on the lower surface of said crank chamber;

(b) an oil pump having an oil intake opening;

(c) an oil filter;

(d) oil passage means provided in said crank chamber coupling said oil filter and said oil pump; and (e) a relief valve provided in said oil passage means, said relief valve being opened by an oil pressure above a predetermined value, wherein said oil passage means includes an opening directed towards the oil pan, and said oil pan includes support means, and wherein said relief valve is inserted in said opening and is fixedly supported therein by being clamped between said support means of said oil pan and said oil passage means.

2. An apparatus of claim 1, wherein said support means comprises a rib formed on the upper surface of said oil pan.

3. An apparatus of claim 1, wherein said oil passage means comprises a tube extending between said oil pump and said oil filter and wherein said apparatus further includes an oil filter screen covering the open end portion of the oil intake opening, said tube and said oil filter screen being fixedly supported by being clamped between said oil pan and the remainder of said oil passage means.

4. An apparatus of claim 3, wherein said oil pan has a pair of upstanding ribs therein and said tube is clamped between said pair of upstanding ribs and the remainder of said oil passage means.

5. An apparatus of claim 2, wherein said rib is an upstanding rib and said relief valve is clamped between a top of said rib and said oil passage means.

* * * * *